US005676772A

United States Patent [19]

Kobayashi et al.

[11] Patent Number: 5,676,772

[45] Date of Patent: Oct. 14, 1997

[54] HIGH-STRENGTH, BAINITIC STEEL RAIL HAVING EXCELLENT DAMAGE-RESISTANCE

[75] Inventors: Kazutaka Kobayashi; Masahisa Fujikake; Sadahiro Yamamoto, all of Tokyo, Japan

[73] Assignee: NKK Corporation, Tokyo, Japan

[21] Appl. No.: 575,164

[22] Filed: Dec. 19, 1995

[30] Foreign Application Priority Data

Sep. 4, 1995 [JP] Japan ..... 7-226529

[51] Int. Cl.[6] ..... C22C 38/18; C22C 38/22; C22C 38/24; C22C 38/26

[52] U.S. Cl. ..... 148/333

[58] Field of Search ..... 148/333, 581, 148/582

[56] References Cited

U.S. PATENT DOCUMENTS 5,209,792 5/1993 Besch et al. .

FOREIGN PATENT DOCUMENTS 2-282448 11/1990 Japan .
6-316728 11/1994 Japan .
6-336614 12/1994 Japan .
7-34133 2/1995 Japan .

*Primary Examiner*—Deborah Yee
*Attorney, Agent, or Firm*—Frishauf, Holtz, Goodman, Langer & Chick, P.C.

[57] ABSTRACT

A high-strength bainitic steel rail having an excellent damage resistance property, essentially consists of 0.2 to 0.5 wt % of C, 0.1 to 2.0 wt % of Si, 0.3 to 4.0 wt % of Mn, 0.035 wt % or less of P, 0.035 wt % of S, and 0.3 to 4.0 wt % of Cr, a balance being Fe, and having a micro structure made of a bainitic structure. This rail includes corner and head side portions having a Vickers hardness of Hv420 or higher, and a head top portion having a hardness of Hv420 or higher at a site 20-mm distant from a center of the head top portion in a width direction, wherein the center of the head top portion has such a hardness distribution that a hardness of the center of the head top portion is 10 to 70 lower in Vickers hardness than that of the site 20-mm distant from the center of the head top portion, a hardness of a section between the center of the head top portion and the site 20-mm away from the center in the width direction increases gradually from the center towards an outer side of the width direction, and a difference between an actual hardness of the section, and a hardness obtained by interpolating the hardness of the center of the head top portion and the hardness of the site 20-mm away from the center in the width direction by straight line, is 10 or less in Vickers hardness.

2 Claims, 4 Drawing Sheets

HIGH-STRENGTH, BAINITIC STEEL RAIL HAVING EXCELLENT DAMAGE-RESISTANCE

BACKGROUND OF THE INVENTION

1. Field of the Invention

The present invention relates to a high-strength bainitic steel rail used for constructing a high-axle load railroad, more particularly, to a high-strength bainitic steel rail a head top portion of which has an excellent damage resistance and a rail corner portion of which has an excellent anti-wear.

2. Description of the Related Art

A conventional anti-wear rail is heat-treated such that the hardness of the corner and head side portions is equal to that of the head top portion. Therefore, as to the material, the anti-wear properties of the rail corner portions are the same as those of the rail head portion.

However, contact between the wheels and the rails is complicated, and the contact pressure vary depending on the position of the rail head-wheel contact. In a sharp curve of a high-axle load railroad, large slip forces act on a corner portion (gauge corner portion) and rail head side surfaces of a rail, with which a wheel is brought into contact. As a result, the rail gauge corner portion and the rail head side portions of the conventional rail are worn much quicker than the rail head top portion. Therefore, the rail head top portion is worn always slower than the rail gauge corner portion, and a maximum contact pressure from each wheel acts on the central portion of the rail head top portion, where wearing proceeds at the slowest rate.

Since the contact state between the wheels and the conventional anti-wear, high-strength rail having uniform wear properties of the rail head is as described above, a local excessive contact stress lasts for a long period of time, and defects caused by fatigue, such as head check and pitching, tend to be formed.

Conventionally, if a defect is created, such a defect is removed by grinding. Further, in some cases, in order to prevent such a defect, the surface layer of the head portion of the rail is ground before fatigue is accumulated on the rail. However, it takes a great amount of time and expense to carry out the grinding, thus causing a load.

Under these circumstances, U.S. Pat. No. 5,209,792 proposes a high-strength and damage-resistance rail having a head top portion the hardness of which is 0.9 or less of that of the corner portion and the head side portions. The feature of this rail is that the contact state is controlled by adjusting the hardness distribution of the head portion, so that the contact pressure from a wheel is not concentrated in a region, thus preventing a head check of the head top portion.

However, with regard to the rail disclosed in this publication, the hardness thereof is changed by heat-treating the pearlite structure, and therefore the fatigue strength is lower than that of the conventional rail at the heat top portion having a low hardness. This publication makes no mention of the hardness distribution of the rail head portion in the width direction.

In the meantime, Jpn. Pat. Appln. KOKAI Publication No. 7-34133 proposes a high-strength bainitic rail to which an anti-wear of the gage corner portion is imparted in addition to the surface damage resistance, by setting different hardnesses to the head top portion and the corner portion of a rail. According to the technique disclosed in this publication, the rolling fatigue damage which may cause the surface damage is removed by maintaining the appropriate wear of the rail, and the occurrence of the surface damage due to plastic deformation which is caused by imparting a high strength to the rail head portion, is avoided.

However, this publication only specifies, in connection with the technique, the hardness ranges for the corner portion and the head top portion of a rail, and makes no mention of the hardness distribution of the rail head portion in the width direction and the difference in hardness between the head top portion and the corner portion.

Jpn. Pat. Appln. KOKAI Publications No. 2-282448, No. 6-316728 and No. 6-336614 each disclose rail to which an anti-surface damage property and an anti-rolling fatigue damage property are imparted by setting different hardnesses to its rail head portion and its corner portions. However, with the techniques of these publications, an anti-wear property of a level required for a high-axle load railroad cannot be maintained since the rails of these techniques have low hardnesses. Further, these publications each only specify the hardness ranges for the corner portions and the head top portion of a rail, and makes no mention of the hardness distribution of the rail head portion in the width direction, and the difference in hardness between the head top portion and the corner portions.

Moreover, if the fatigue strength of the rail head portion is lower than that of the conventional pearlite rail as in the technique described U.S. Pat. No. 5,209,792, the problem in which the damage resistance is lowered, occurs.

None of these publications discusses the hardness distribution of the rail head portion in the width direction; however the occurrence of damages to the head top portion depends on the contact stress, and the contact stress and its distribution further depend on the distribution of the wearing rate of the head top portion, that is, the distribution of the hardness of the rail head portion in the width direction. Consequently, with the above-described conventional technique which does not specify the hardness distribution of the rail head portion in the width direction, it is not always possible to obtain a damage reducing effect.

Further, if the difference between the head top portion and the corner portion in hardness becomes excessively large, the contact pressure at the center of the head top portion is significantly reduced, but the life of the rail as a whole is shortened.

SUMMARY OF THE INVENTION

An object of the present invention is to provide a high-strength having an excellent contact fatigue damage resistance and a long life, and capable of reducing the track maintenance expense.

According to the first aspect of the present invention, there is provided a high-strength bainitic steel rail having an excellent damage resistance property, essentially consisting of 0.2 to 0.5 wt % of C, 0.1 to 2.0 wt % of Si, 0.3 to 4.0 wt % of Mn, 0.035 wt % or less of P, 0.035 wt % of S, and 0.3 to 4.0 wt % of Cr, a balance being Fe, having a micro structure made of a bainitic structure, and comprising corner and head side portions having a Vickers hardness of Hv420 or higher, and a head top portion having a hardness of Hv420 or higher at a site 20-mm distant from a center of the head top portion in a width direction, wherein the center of the head top portion has such a hardness distribution that a hardness of the center of the head top portion is 10 to 70 lower in Vickers hardness than that of the site 20-mm distant from the center of the head top portion, a hardness of a section between the center of the head top portion and the site 20-mm away from the center in the width direction increases gradually from the center towards an outer side of the width direction, and a difference between an actual hardness of the section, and a hardness obtained by interpolating the hardness of the center of the head top portion and the hardness of the site 20-mm away from the center in the width direction by straight line, is 10 or less in Vickers hardness.

According to the second aspect of the invention, there is provided a high-strength bainitic steel rail having an excellent damage resistance property, essentially consisting of 0.2 to 0.5 wt % of C, 0.1 to 2.0 wt % of Si, 0.3 to 4.0 wt % of Mn, 0.035 wt % or less of P, 0.035 wt % of S, and 0.3 to 4.0 wt % of Cr, at least one of the group consisting of 0.1 to 1.0 wt % of Ni, 0.1 to 1.0 wt % of Mo, 0.01 to 0.2 wt % of Nb and 0.01 to 0.2 wt % of V, a balance being Fe, having a micro structure made of a bainitic structure, and comprising corner and head side portions having a Vickers hardness of Hv420 or higher, and a head top portion having a hardness of Hv420 or higher at a site 20-mm distant from a center of the head top portion in a width direction, wherein the center of the head top portion has such a hardness distribution that a hardness of the center of the head top portion is 10 to 70 lower in Vickers hardness than that of the site 20-mm distant from the center of the head top portion, a hardness of a section between the center of the head top portion and the site 20-mm away from the center in the width direction increases gradually from the center towards an outer side of the width direction, and a difference between an actual hardness of the section, and a hardness obtained by interpolating the hardness of the center of the head top portion and the hardness of the site 20-mm away from the center in the width direction by straight line, is 10 or less in Vickers hardness.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
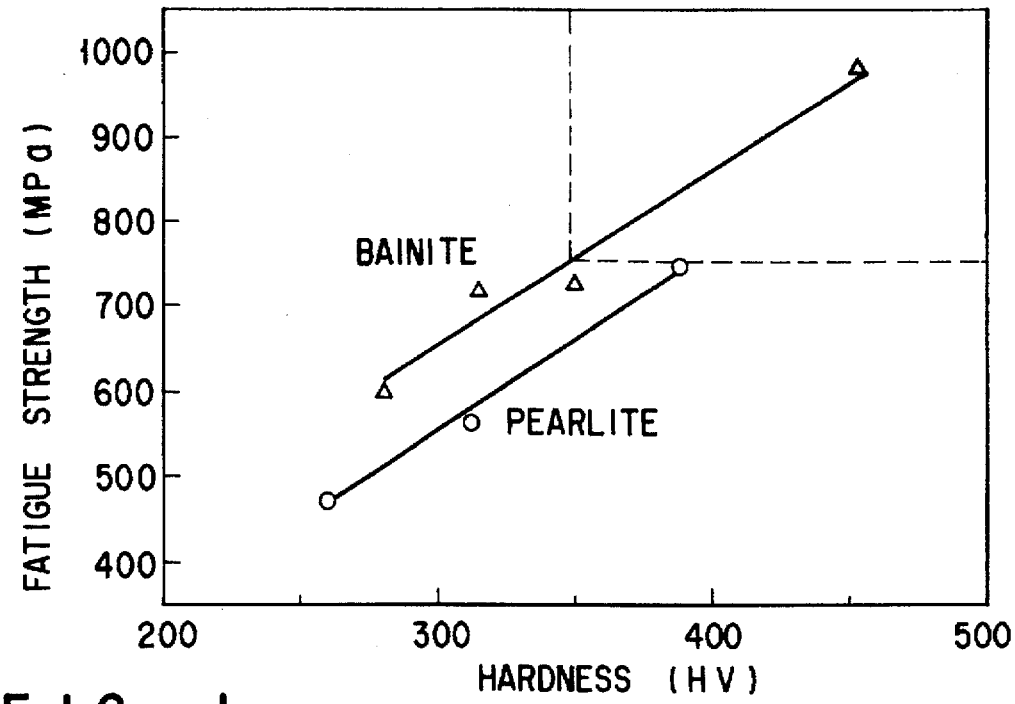
FIG. 1 is a graph showing the relationship between hardness and fatigue strength in a bainitic steel and a pearlite steel.

The occurrence of damage to a rail head top portion depends on the contact stress, and the contact stress and its distribution vary as the fitting proceeds due to wear. The variation process depends on the distribution of the wear rate, and the hardness distribution in the rail width direction.

According to the studies of the present inventors, the damage can be significantly reduced by the technique disclosed in the above prior art publications only if the hardness distribution is appropriate. It is found that, with an inappropriate distribution, a local concentration of contact stress occurs as the fitting proceeds due to wear, thereby possibly vanishing the damage reduction effect.

More specifically, the above prior art publications disclose only the range of the hardness of each of the corner portion and the head side portion, and the range of the hardness of the head top portion, and makes no mention of the hardness distribution in the rail width direction. Therefore, such a hardness distribution that the contact stress at the head top portion and its distribution are rendered appropriate, may not be obtained.

According to the technique discussed in U.S. Pat. No. 5,209,792, the hardness of the head top portion is defined to be 0.9 or less of that of the corner portion and the head side portion. With this structure, the contact stress of the head top portion is in fact significantly reduced. However, according to the intensive studies of the present inventors, it was found that if there is such a large difference in hardness between the head top portion and the corner portion, a large contact stress is generated at the end portion of the contact portion, which is located away from the center of the contact portion in the width direction, in reaction to the significant reduction of the contact stress at the head top portion, and damage may occur and increase at the site. As a result, the life of the rail as a whole is shortened. Further, in the conventional on-line heat treatment-type pearlite rail, when the hardness of its head top portion is lowered, the fatigue strength is decreased to a level lower than that of the conventional technique.

In the present invention, as described above, the hardness distribution of the rail head top portion in the width direction is controlled, and the variation of the contact stress, which takes place as the fitting progresses is controlled. Thus, a local concentration of fatigue accumulation at the head top portion of the rail is avoided and a bainitic steel having a specific composition is used, thereby improving the contact fatigue damage resistance of the head top portion having a low hardness.

The present invention will now be described in detail.

(Content Composition)

The rail of the present invention essentially contains 0.2 to 0.5 wt % of C, 0.1 to 2.0 wt % of Si, 0.3 to 4.0 wt % of Mn, 0.035 wt % or less of P, 0.035 wt % of S, and 0.3 to 4.0 wt % of Cr. The rail of the present invention further contains selectively at least one of the group consisting of 0.1 to 1.0 wt % of Ni, 0.1 to 1.0 wt % of Mo, 0.01 to 0.2 wt % of Nb and 0.01 to 0.2 wt % of V.

The following are reasons why the range of each content was defined as above.

C: 0.2 to 0.5 wt %

C is an essential element to obtain a certain strength and a certain anti-wear property. However, if its content is less than 0.2%, it is difficult to obtain an appropriate hardness as a rail steel at a low cost, whereas if the content exceeds 0.5%, a uniform bainitic structure cannot be formed at the rail head portion thereof. Therefore, the C content was set in a range of 0.2 to 0.5 wt %.

Si: 0.1 to 2.0 wt %

Si is an element not only effective as a deoxidizing agent, but also is dissolved into ferrite in the bainitic structure so as to increase the strength and improve the anti-wear property. However, if its content is less than 0.1%, the effect of the element cannot be obtained, whereas if the content exceeds 2.0%, the steel is embrittled. Therefore, the S content was set in a range of 0.1 to 2.0 wt %.

Mn: 0.3 to 4.0 wt %

Mn is an element which contributes to high strengthening of a rail by lowering its bainitic transformation temperature and raising the hardenability. However, if its content is less than 0.3%, the effect of the element is not significant, whereas if the content exceeds 4.0%, a martensite structure due to the micro-segregation of steel is easily created. Therefore, the steel is hardened and embrittled during the heat treatment and welding, thus causing the degradation of the material. Therefore, the Mn content was set in a range of 0.3 to 4.0 wt %.

P: 0.035 wt % or less

P is an element which degrades the toughness, and therefore its content was set to 0.035 wt % or less.

S: 0.035 wt % or less 5 S is present in the steel mainly in the form of inclusion. However, if the content exceeds 0.035%, the amount of the inclusion is significantly increased, causing the degradation of the material due to embrittlement. Therefore, the content was set to 0.035 wt % or less.

Cr: 0.3 to 4.0 wt %

Cr serves to increase the bainitic hardenability, and is a very important element for highly strengthening a steel as a bainitic structure as in the microstructure of the steel of the present invention. However, if the content is less than 0.3 wt %, the bainitic hardenability becomes low and the microstructure cannot become a uniform bainitic structure, whereas the content exceeds 4.0 wt %, a martensite is easily created, which is not desirable. Therefore, the Cr content is set within a range of 0.3 to 4.0 wt %.

Ni: 0.1 to 1.0 wt %

Mo: 0.1 to 1.0 wt %

Ni and Mo each is dissolved in bainite so as to improve the bainitic hardenability, and is an effective element for highly strengthening a steel. However, if the amount of addition is less than the lower limit of the above range, the effect of the element is not evident, whereas if the amount of addition exceeds the upper limit, regardless of an increase in content, the effect, i.e. improvement of the hardenability, remains the same. Therefore, it is effective that at least one of these elements are added in the above-specified range.

Nb: 0.01 to 0.2 wt %

V: 0.01 to 0.2 wt %

Nb and V each bond to C in bainite and precipitates after rolling, and therefore they are effective for improving the anti-wear while increasing the hardness by precipitation hardening even in the inside of the head portion, thus extending the life of the rail. However, if the amount of addition is less than the lower limit of the above range, the effect of the element is not evident, whereas if the amount of addition exceeds the upper limit, regardless of an increase in content, the effect, i.e. improvement of the hardenability, remains the same. Therefore, it is effective that at least one of these elements are added in the above-specified range.

(Micro structure)

In the present invention, the rail is formed to have a bainitic structure. A bainitic structure, as compared to the pearlite structure of the conventional rail, has an increased dislocation density, and accordingly has a high hardness and a high toughness, thus making it possible to decrease the C content lower than that of the pearlite steel.

(Hardness and Its Distribution)

FIG. 1 shows the relationship between a hardness and a fatigue strength. As can be seen in this figure, a bainitic steel has a higher fatigue strength than that of a pearlite steel when they are compared at the same hardness. Therefore, a bainitic steel, if it has a hardness of Hv350 or higher, can obtain a fatigue strength of the same level or higher than that of the conventional heat-treatment type pearlite rail.

The corner portions are exposed to severe contact conditions with regard to a wheel, and therefore they must have an anti-wear of the same level as that of the conventional on-line heat treatment type pearlite rail.

Although it is mostly preferable that the wear amount should be evaluated by the amount of wear of a rail actually formed, it is also effective to use a experiment in which the contact conditions of an actually formed rail are simulated by use of a Nishihara-type wear tester. With use of this testing method, the anti-wear (i.e. the relationship between hardness and wear reducing rate) can be evaluated in a short period of time. The following are results of the evaluation made by this method.

Figure 2:
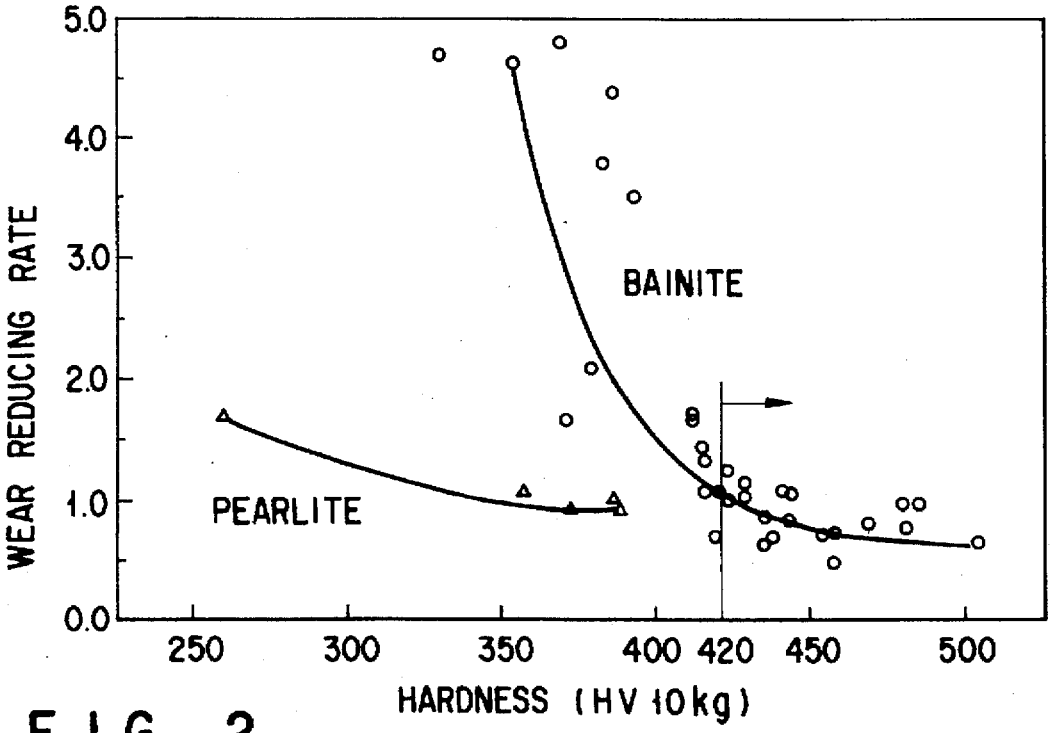
FIG. 2 is a graph illustrating the influence of the hardness on the wear reducing rate.

FIG. 2 shows the results of the examination of the influence of a hardness on an wear reducing ratio. As the sample steels, a conventional pearlite rail and a bainitic steel the hardness of which was varied to Hv330 to Hv510, were used. From these steels, Nishihara-type wear test pieces each having an outer diameter of 30 mm and a width of 8 mm, were sampled. The sample pieces were subjected to the wear test under the following conditions, that is, a contact load of 50 kg, a slip rate of −10%, and without a lubricant, in which the reduced amount due to wear after five hundred thousand rotations was measured. In the evaluation, the reduced amount of the on-line heat treatment type pearlite rail was measured, and the reduced amount ratio of each of the sample steels due to wear with respect to that of the on-line heat treatment type pearlite rail was obtained.

The hardness of the on-line heat treatment type pearlite rail is about Hv390. As can be understood from FIG. 2, as the hardness increases, the wear reduction amount ratio decreases. For the same hardness, the bainitic structure as a larger wear reduction amount ratio than that of the pearlite. In the bainitic steel, if the hardness becomes Hv420 or higher, the wear reduction amount ratio thereof is lowered to a level of that of the on-line heat treatment type pearlite rail. Consequently, in order to obtain an anti-wear property of a level equal to or higher than that of the on-line heat treatment type pearlite rail presently used, the hardness of the head corner portions is set to Hv420 or higher in the present invention.

With regard to the head top portion, the contact width between the rail and a wheel is at the minimum when the rail is brand new or immediately after grinding (normally about 10 mm in high-axle load rail), and the contact width gradually becomes wider as the fitting proceeds due to wear, thus dispersing the contact force. In consideration of this, a numerical simulation was carried out with regard to the relationship between the distribution of the contact stress and the hardness distribution.

Figure 3:
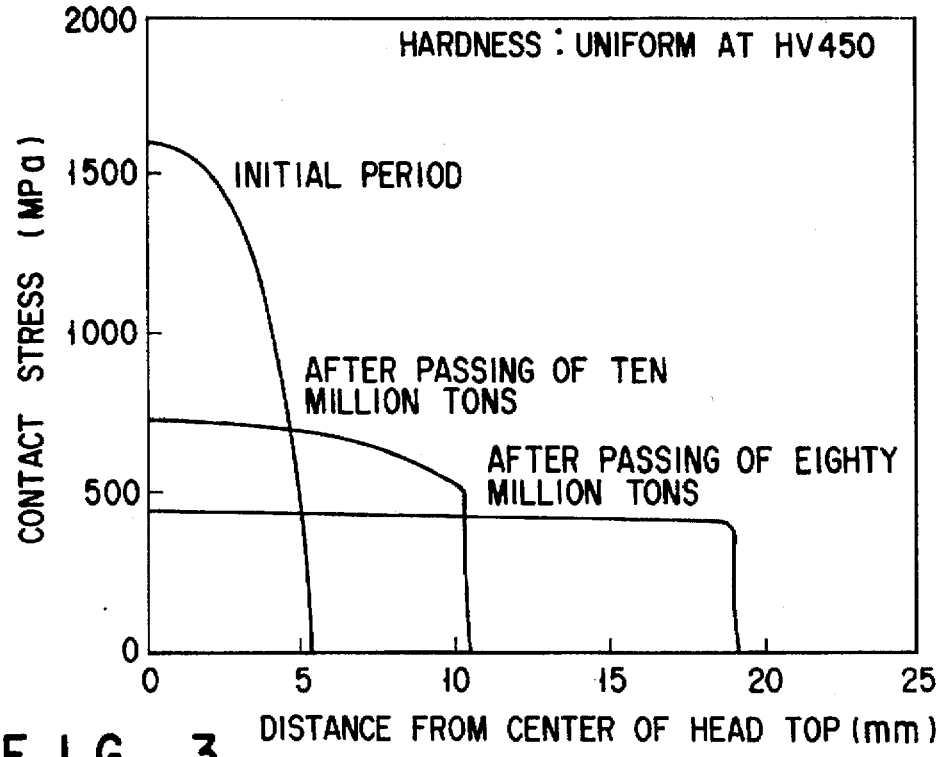
FIG. 3 is a graph showing the distribution of the contact stress of a rail in the width direction, the hardness of the head top portion of which is uniformly Hv450.

FIG. 3 is a graph showing the distribution of the contact stress in the width direction of a rail the hardness of the head top portion of which is uniform at Hv450. This figure shows only the right half part with respect to the center of the head top portion.

As can be seen in the figure, when the rail is brand new or in the initial period of use just after being ground, the contact stress distribution is gradually flattened as the fitting due to wear proceeds. However, even if the fitting proceeded, the contact stress is largest always at the center portion of the head top portion, and therefore the fatigue accumulation is concentrated on the center portion of the head top portion, thus causing damages including a head check, to the center portion of the head top portion.

Figure 4:
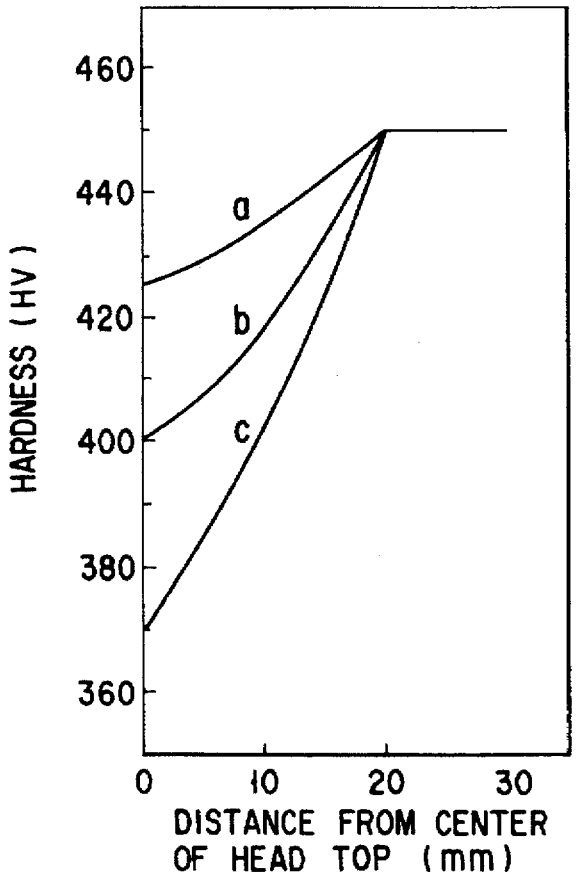
FIG. 4 is a graph showing the hardness distribution of the head top portion of a sample rail piece, used for examining the contact stress.

Next, head top portions having three types of hard distributions (cases a, b and c) as shown in FIG. 4 were examined in terms of contact stress distribution. In the case a, the hardness of the center of the head top portion is 25 lower than the hardness of the site 20-mm away from the center in the width direction in Vickers hardness, in the case b, the hardness of the center is 50 lower, and in the case c, the harness of the center is 80 lower.

Figure 5:
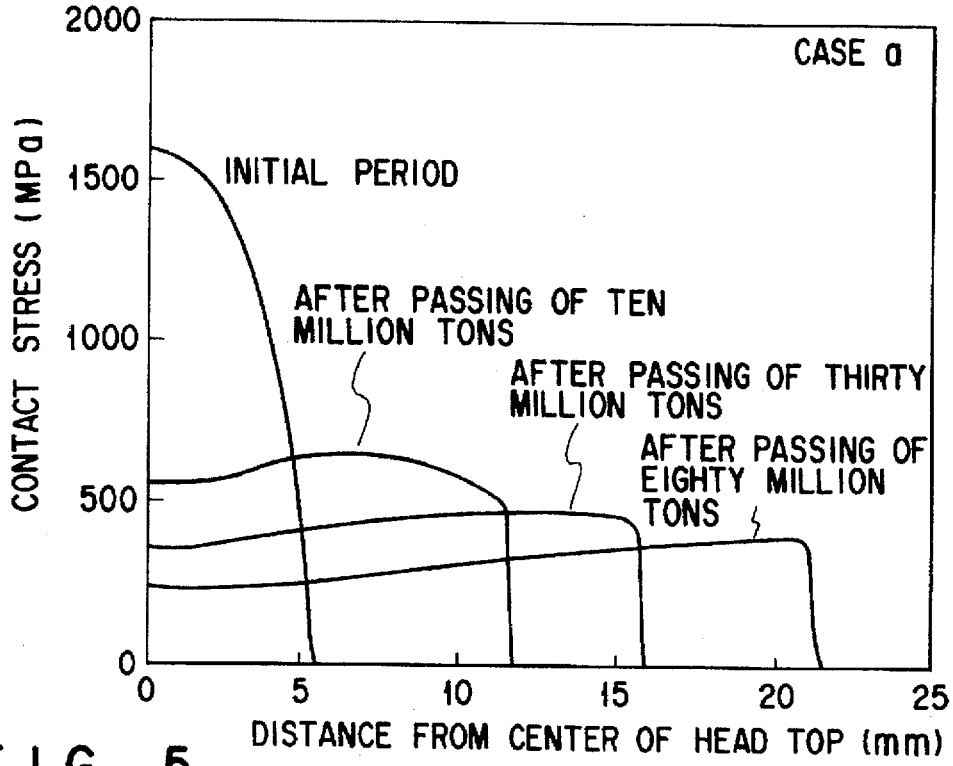
FIG. 5 is a graph showing variations of contact stress distributions, which take place as the fitting proceeds due to the wear in a rail of the present invention.

FIG. 5 shows the contact stress distribution of the case a. As is clear from this figure, when the contact stress at the center of the head top portion of the rail decreases, the contact stress at the end portion of the contact portion increases, and the peak of the contact stress shifts from the center of the head top portion to the end portion of the contact portion. Consequently, the fatigue accumulation increases at the end portion. However, as the fitting progresses due to wear, the site where the contact stress is at maximum, shifts gradually from the center of the head top portion to the end portion in the rail width direction. Therefore, the accumulation of the fatigue is dispersed. Therefore, as a whole, damage to the rail can be reduced.

The inventors of the present invention has found in the course of intensive studies that the phenomenon that the contact stress of the center of the head top portion decreases and the peak position of the contact stress moves, depends mostly on the hardness distribution of the section from the center of the hear top portion to the site 20-mm away from the center in the width direction. In the case where the hardness of this section increases gradually and substantially linearly from the center of the head top portion towards the outer side of the width direction, the above-described phenomenon occurs smoothly. However, if there is a site where, for example, the hardness changes its usual manner from increasing to decreasing, the contact stress at the site increases excessively, causing damage.

Therefore, it is defined in the present invention that the hardness of the section between the center of the head top portion and the site 20-mm away from the center in the width direction increases gradually from the center towards the outer side of the width direction, and the difference between the actual hardness of the section, and the hardness obtained by interpolating the hardness of the center of the head top portion and the hardness of the site 20-mm away from the center in the width direction by straight line, is 10 or less in Vickers hardness.

Figure 6:
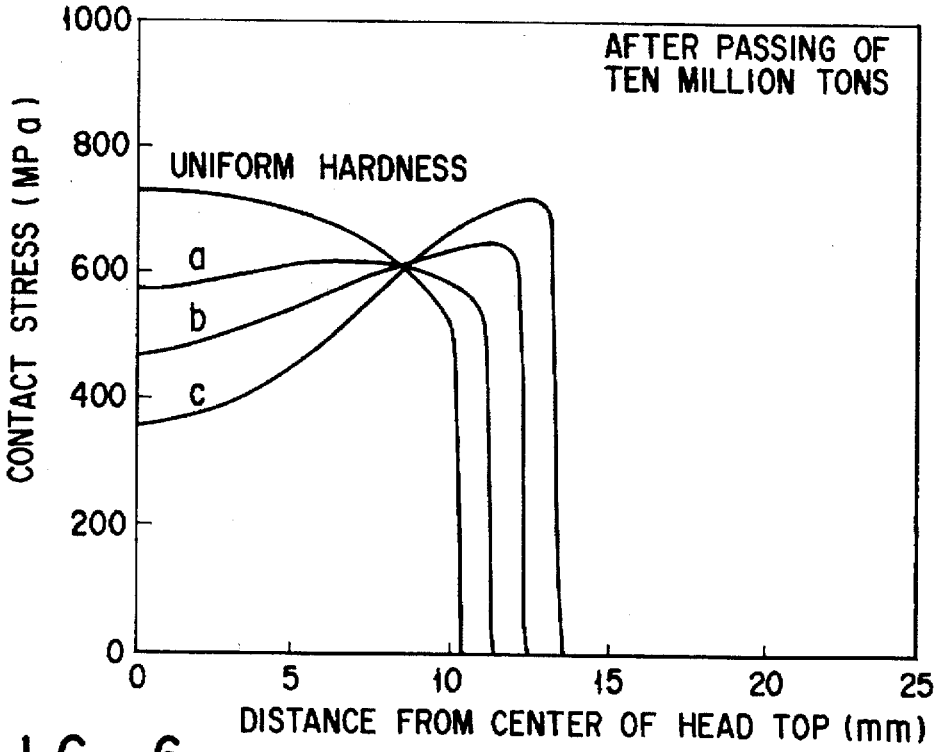
FIG. 6 is a graph showing the contact stress distributions of the head top portions of the rail of the present invention, the rail of the comparative example, and the rail having a head top portion whose hardness distribution is uniform, after passing of ten million tons.
Figure 7:
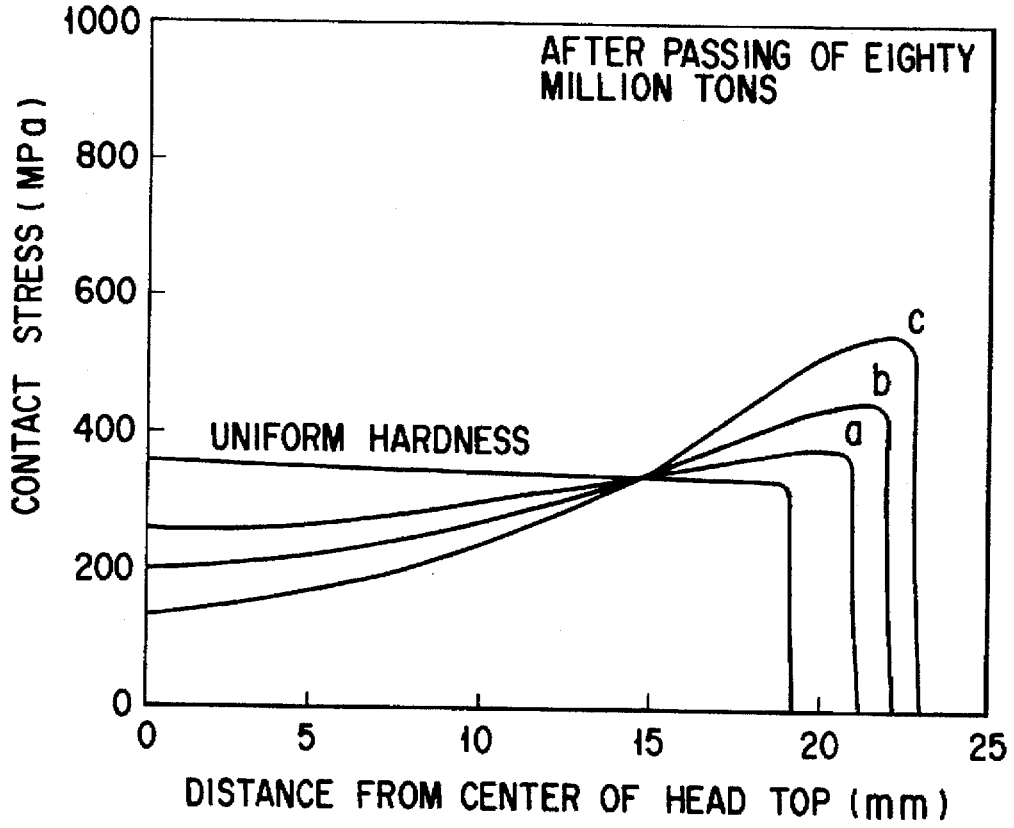
FIG. 7 is a graph showing the contact stress distributions of the head top portions of the rail of the present invention, the rail of the comparative example, and the rail having a head top portion whose hardness distribution is uniform, after passing of eighty million tons.

FIGS. 6 and 7 show contact stress distributions at passing of ten million tons and eighty million tons, respectively, of the cases a to c, in comparison with the rail having a uniform hardness shown in FIG. 3. As is clear from these figures, the contact stress at the center of the head top portion of each of the rails (of the cases a, b and c) in which the hardness was varied, decreases in a short period of time as compared to the rail having the uniform hardness. In the case where the variation of the hardness is wide, such a phenomenon is prominent. This is because the hardness at the center is low, and the wear progresses more rapidly at the center than the peripheral portions. Thus, the fatigue accumulation at the center of the head top portion can be significantly reduced.

However, if the difference between the hardness of the center of the head top portion and that of the site 20-mm away from the center in the width direction becomes large, the peak of the contact stress acting on the end portion of the contact portion is rendered high. In the cases a and b, the peak value of the contact stress at passing of ten million tons is smaller than that of the rail having a uniform hardness. However, in the case c where the difference in hardness is as large as 80 in Vickers hardness, the peak value of the contact stress becomes large as in the case of the rail having a uniform thickness, causing damages. For this reason, it is defined in the present invention that the upper limit of the difference between the hardness of the center of the head top portion and that of the site 20-mm away from the center in the width direction is 70 in Vickers hardness.

On the other hand, if the difference between the hardness of the center of the head top portion and that of the site 20-mm away from the center in the width direction is too small, such a contact stress distribution to decrease the damage will not be sufficiently exhibited. Therefore, the lower limit of the difference in hardness is set to 10 in Vickers hardness.

The hardness at the site 20-mm away from the center in the width direction is set to be Hv420 or higher for the same reason as of setting the hardness of the corner portions and head side portions. Even in the case where the hardness at the site 20-mm away from the center in the width direction is set to be Hv420, and the upper limit of the difference in hardness is 70 in Vickers hardness, the hardness at the center of the head top portion is Hv350, and therefore a fatigue strength of about the same level as that of the conventional heat-treatment type pearlite rail can be obtained as described above, and the damage resistance is not lowered.

Although the hardness of the section between the site 20-mm away from the center in the width direction and the corner portion does not have a great influence on the contact stress, it is preferable that the hardness should not greatly vary, but be substantially uniform, or smoothly and gradually change.

In the actual production, a slight variation of the hardness is inevitable, and therefore there may be some sites where the hardness does not successively increases in the width direction in terms of a micro-sense. However, in the present invention, it suffices only if the hardness increases successively in terms of a macro-sense.

With regard to the hardness in the depth direction, it is preferable that the surface portion of a depth of at least 10 mm from the head top surface, possibly down to 23 mm, should satisfy the hardness conditions of the present invention within its horizontal cross section. With this constitution, even if the wear of the rail remarkably progresses, the damage can be decreased.

According to the present invention, the strength and anti-wear property of the rail are maintained by increasing the hardness of the head side portions, the corner portions, and the sections between the site 20-mm away from the center of the head top portion in the width direction and the corner portions, to a sufficient degree. In the head top portion, the hardness of the center thereof is rendered lower than that of the site 20-mm away from the center in the width direction, and the hardness at a mid position between the center and the site is adjusted to vary substantially linearly, and as the fitting progresses due to wear, the contact stress of the center portion of the head top portion, which has a high wear rate, decreases, thus suppressing the damage to that portion. Further, the wear rate of the head top portion is appropriately controlled in the width direction, and therefore the peak value of the contact stress acting on the end of the contact portion does not adversely affect. Also, the peak position moves, and the fatigue accumulation does not concentrates on one point, but disperses over the head top surface. Therefore, the fatigue damage is suppressed, and the number of times of grinding can be reduced. Consequently, the maintenance cost of the track can be reduced, and the life of the rail can be prolonged.

The rail of the present invention, which has the above-described composition, hardness and the hardness distribution, can be manufactured by supplying air to the rail top portion so as to cool it, immediately after completion of rolling of the rail or after re-heating the rail which was once cooled. While supplying the air, the air pressures applied to the center portion of the head top portion, the corner portions and the head side portions are changed in order to adjust the hardness distribution at the head portion in various ways.

EXAMPLE

Steels having content compositions specified in Table 1 were rolled into rail shapes, and the head portions thereof were subjected to the heat treatment, thus obtaining rails having head portions with various hardness distributions. After the rolling, these rail stocks were placed into a cooling device in an on-line manner, where air was supplied to the head portion of each rail stock for cooling, thus manufacturing rails. During this step, the air pressures applied to the center portion of the head top portion, the corner portion and the head side portions were changed to adjust the hardness of each portion. With a low air pressure applied to the center portion of the head top portion and a high air pressure applied to the corner portions, a rail having such a hardness distribution that the hardness gradually increases in a linear manner from the center of the head top portion to the site 20-mm away from the center in the width direction, was prepared.

TABLE 1

(wt %)

| Steel type | C | Si | Mn | P | S | Ni | Cr | Mo | Nb | V | sol. Al |
|---|---|---|---|---|---|---|---|---|---|---|---|
| A | 0.79 | 0.45 | 0.95 | 0.021 | 0.005 | — | 0.21 | — | — | 0.06 | 0.005 |
| B | 0.39 | 0.15 | 2.01 | 0.017 | 0.004 | — | 0.50 | 0.19 | 0.10 | — | 0.005 |
| C | 0.31 | 0.33 | 1.72 | 0.017 | 0.004 | — | 2.02 | — | — | — | 0.005 |
| D | 0.30 | 0.15 | 1.98 | 0.017 | 0.004 | — | 0.52 | 0.50 | 0.10 | — | 0.005 |
| E | 0.41 | 0.29 | 0.50 | 0.019 | 0.006 | — | 2.50 | — | — | — | 0.005 |
| F | 0.40 | 0.11 | 1.11 | 0.019 | 0.004 | — | 2.03 | — | 0.10 | — | 0.005 |
| G | 0.39 | 0.30 | 1.70 | 0.018 | 0.005 | 0.21 | 1.49 | — | — | — | 0.002 |
| H | 0.29 | 0.31 | 1.99 | 0.002 | 0.002 | — | 1.52 | — | — | 0.12 | 0.004 |

The hardness and distribution of the head top of each of these rails are summarized in TABLE 2.

As mentioned before, the lives of the rails should most preferably be evaluated using actually formed rails; however such a method requires a great amount of time. For this reason, the evaluation was carried out by the test in which the contact conditions of the actually formed rails were simulated with use of a two-cylinder type rail-wheel contact fatigue testing device (rotation movement fatigue device). The results thereof were also summarized in Table 2. In Table 2, the damage life of each test piece was expressed in the ratio with respect to the damage life of a test piece corresponding to the rail having a uniform hardness.

TABLE 2

| Steel type | Hardness of center of head top portion HV | Hardness of site 20 mm away from center of head top portion HV | Difference in hardness HV | Difference between hardness of center and linearly interpolated hardness (maximum) HV | Rate of damage life with regard to conventional rail | Remarks |
|---|---|---|---|---|---|---|
| A | 386 | 389 | 3 | 2 | 1.0 | Conventional rail |
| B | 435 | 440 | 5 | 2 | 1.2 | Comparative rail |
| | 417 | 428 | 11 | 2 | 1.4 | Present invention |
| | 424 | 445 | 21 | 6 | 1.7 | rail |
| | 432 | 469 | 37 | 8 | 2.2 | |
| | 400 | 456 | 56 | 9 | 1.8 | |
| | 410 | 488 | 78 | 14 | 1.2 | Comparative rail |
| C | 466 | 469 | 3 | 2 | 1.1 | Comparative rail |
| | 434 | 456 | 22 | 5 | 1.6 | Present invention |
| | 442 | 483 | 41 | 6 | 2.0 | rail |
| | 429 | 506 | 77 | 13 | 1.2 | Comparative rail |
| D | 430 | 432 | 2 | 2 | 1.2 | Comparative rail |
| | 424 | 440 | 16 | 4 | 1.5 | Present invention |
| | 405 | 433 | 28 | 6 | 1.8 | rail |
| | 415 | 459 | 44 | 5 | 2.1 | |
| | 404 | 458 | 54 | 8 | 1.8 | |
| | 423 | 490 | 67 | 8 | 1.4 | |
| | 406 | 486 | 80 | 12 | 1.1 | Comparative rail |
| E | 442 | 445 | 3 | 2 | 1.1 | Comparative rail |
| | 414 | 436 | 24 | 5 | 1.6 | Present invention |
| | 418 | 453 | 35 | 5 | 1.9 | rail |
| | 409 | 464 | 55 | 8 | 1.7 | |
| | 401 | 593 | 92 | 11 | 1.2 | Comparative |
| F | 458 | 450 | 2 | 2 | 1.0 | Comparative rail |
| | 429 | 452 | 23 | 4 | 1.4 | Present invention |
| | 433 | 473 | 40 | 6 | 1.8 | rail |
| G | 404 | 429 | 25 | 6 | 1.7 | Present invention rail |
| H | 417 | 419 | 2 | 2 | 1.1 | Comparative rail |
| | 408 | 440 | 32 | 6 | 1.7 | Present invention rail |

As shown in FIG. 2, with the test pieces each having a hardness distribution within the range defined by the present invention, the damage life was improved 1.4 times longer or more than that of the conventional rail having a uniform hardness, with the maximum improvement of 2.2 times.

It was thus confirmed from the results of the test that the hardness distribution of the head top portion defined in the present invention, with which the contact stress of the central portion of the head top portion can be reduced, the peak value of the contact stress acting on the end of the contact portion can be suppressed, and the fatigue accumulation can be dispersed by moving the peak position from the center of the head top portion towards the outer side of the width direction, is effective for prolonging the damage life.

As described, according to the present invention, damage to the head top portion, which occurs due to a excessive contact pressure such as head check, can be suppressed; and therefore the number of times of grinding of the rail can be decreased. Consequently, the track maintenance cost can be reduced, and the life of the rail can be prolonged.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A high-strength bainitic steel rail having an excellent damage resistance property, consisting essentially of 0.2 to 0.5 wt % of C, 0.1 to 2.0 wt % of 5 Si, 0.3 to 4.0 wt % of Mn, 0.035 wt % or less of P, 0.035 wt % or less of S, and 0.3 to 4.0 wt % of Cr, a balance being Fe, having a micro structure made of a bainitic structure, and comprising corner and head side portions having a Vickers hardness of Hv420 or higher, and a head top portion having a hardness of Hv420 or higher at a site 20-mm distant from a center of the head top portion in a width direction, wherein the center of the head top portion has such a hardness distribution that a hardness of the center of the head top portion is 10 to 70 lower in Vickers hardness than that of the site 20-mm distant from the center of the head top portion, a hardness of a section between the center of the head top portion and the site 20-mm away from the center in the width direction increases gradually from the center towards an outer side of the width direction, and a difference between an actual hardness of the section, and a hardness obtained by interpolating the hardness of the center of the head top portion and the hardness of the site 20-mm away from the center in the width direction by straight line, is 10 or less in Vickers hardness.

2. A high-strength bainitic steel rail having an excellent damage resistance property, consisting essentially of 0.2 to 0.5 wt % of C, 0.1 to 2.0 wt % of Si, 0.3 to 4.0 wt % of Mn, 0.035 wt % or less of P, 0.035 wt % or less of S, and 0.3 to 4.0 wt % of Cr, at least one of the group consisting of 0.1 to 1.0 wt % of Ni, 0.1 to 1.0 wt % of Mo, 0.01 to 0.2 wt % of Nb and 0.01 to 0.2 wt % of V, a balance being Fe, having a micro structure made of a bainitic structure, and comprising corner and head side portions having a Vickers hardness of Hv420 or higher, and a head top portion having a hardness of Hv420 or higher at a site 20-mm distant from a center of the head top portion in a width direction, wherein the center of the head top portion has such a hardness distribution that a hardness of the center of the head top portion is 10 to 70 lower in Vickers hardness than that of the site 20-mm distant from the center of the head top portion, a hardness of a section between the center of the head top portion and the site 20-mm away from the center in the width direction increases gradually from the center towards an outer side of the width direction, and a difference between an actual hardness of the section, and a hardness obtained by interpolating the hardness of the center of the head top portion and the hardness of the site 20-mm away from the center in the width direction by straight line, is 10 or less in Vickers hardness.

* * * * *